US009993121B1

(12) United States Patent
Chang

(10) Patent No.: US 9,993,121 B1
(45) Date of Patent: Jun. 12, 2018

(54) BATHING TOOL WITH DETACHABLE HANDLE

(71) Applicant: OLIVETTE INDUSTRIES CO., LTD., Changhua County (TW)

(72) Inventor: Che-Yuan Chang, Yuanlin (TW)

(73) Assignee: OLIVETTE INDUSTRIES CO., LTD., Changhua County (TW)

( * ) Notice: Subject to any disclaimer, the term of this patent is extended or adjusted under 35 U.S.C. 154(b) by 0 days. days.

(21) Appl. No.: 15/710,151

(22) Filed: Sep. 20, 2017

(30) Foreign Application Priority Data

Jul. 28, 2017 (TW) ..... 106125529 A

(51) Int. Cl.
*A47K 7/02* (2006.01)

(52) U.S. Cl.
CPC ..... *A47K 7/028* (2013.01); *A47K 7/024* (2013.01); *A47K 7/026* (2013.01)

(58) Field of Classification Search
CPC ..... A47K 7/024; A47K 7/026; A47K 7/028
USPC ..... 4/606
See application file for complete search history.

(56) References Cited

U.S. PATENT DOCUMENTS 5,175,896 A 1/1993 Zamir
7,500,282 B1 3/2009 Park
8,869,341 B2 * 10/2014 Bayham ..... A47K 7/028 15/209.1
2011/0010841 A1 * 1/2011 Chang ..... A47K 7/02 4/606

* cited by examiner

*Primary Examiner* — Tuan N Nguyen
(74) *Attorney, Agent, or Firm* — Muncy, Geissler, Olds & Lowe, P.C.

(57) ABSTRACT

A bathing tool consisting of a bathing ball and a handle is disposed. The bathing ball includes a base including a first back panel with equiangularly spaced first rib portions and a second back panel with equiangularly spaced second rib portions arranged in a stack. The first and second rib portions are alternatively arranged in a stagger manner, having respectively a first mating connection portion and a second mating connection portion. The handle is detachably connected to one second rib portion of the second back panel. Thus, on the one hand, the present invention allows the user to operate the bathing ball through the handle to clean every part of the body of a person, and on the other hand, the mating between the first and second mating connection portions allows multiple bathing balls to be connected together to expand the bathing area.

21 Claims, 15 Drawing Sheets

BATHING TOOL WITH DETACHABLE HANDLE

BACKGROUND OF THE INVENTION

1. Field of the Invention

The present invention relates to bathing tool technology and more particularly, to a bathing tool with detachable handle that facilitates the user to operate the bathing ball for scrubbing every part of the body.

2. Description of the Related Art

In the use of a conventional bathing tool (such as a bathing ball or sponge), the user needs to directly hold the bathing tool with the hand, and then to move the hand in scrubbing the bathing tool back and forth over every part of the body for cleaning. However, in the process of cleaning the body, there are many dead angles around the back of the body that the bathing tool cannot reach to thoroughly clean the back.

In order to solve the aforesaid problem, U.S. Pat. No. 5,175,896 discloses a bathroom accessory, which comprises a base member, suction cups on one face of the base member for removably mounting the accessory to a mounting surface, such as the wall of a shower or the wall of or adjacent to a bathtub, and a plurality of projections projecting from the opposite face of the base member for massaging the back of user when the accessory is mounted to the mounting surface. However, since this bathroom accessory has a fixed size, its bathing area is limited, so the cleaning effect is not satisfactory. Further, U.S. Pat. No. 7,500,282 discloses a bathing tool that allows change of the bathing area by a splicing method. However, in the structural design, the suction cup is easy to fall from the base because the suction cup simply has the front end thereof inserted into the locating hole in the base, resulting in inconvenience in use.

SUMMARY OF THE INVENTION

The present invention has been accomplished under the circumstances in view. It is the main object of the present invention to provide a bathing tool with a detachable handle, which facilitates the user to operate a bathing ball for scrubbing every part of the body of a person.

To achieve this and other objects of the present invention, a bathing tool comprises a bathing ball and a handle. The bathing ball comprises a base and a bathing ball body. The base comprises a first back panel and a second back panel. The first back panel comprises a first mounting portion, and a plurality of first rib portions outwardly extended from the periphery of the first mounting portion and equiangularly spaced around the first mounting portion. Each first rib portion comprises a first mating connection portion. The second back panel comprises a second mounting portion, and a plurality of second rib portions outwardly extended from the periphery of the second mounting portion and equiangularly spaced around the second mounting portion. The second mounting portion has a front side thereof connected to a back side of the first mounting portion of the first back panel. The second rib portions of the second back panel and the first rib portions of the first back panel are alternatively arranged in a staggered manner. Each second rib portion comprises a second mating connection portion configured to mate with the first mating connection portion. The bathing ball body is located at a front side of the first back panel of the base. The first mating connection portions are structurally configured to mate with the second mating connection portions. For example, the first mating connection portions are stepped rods; the second mating connection portions are stepped through holes fitting the stepped rods. The handle comprises a third mating connection portion detachably connectable to one second mating connection portion of the second back panel of the base of the bathing ball.

In general, the bathing tool allows the user to operate the handle in scrubbing the bathing ball over the back, the sole or any other part of the body for thorough cleaning, increasing the ease of use. Further, the mating design between the first mating connection portions and the second mating connection portions allows connection of multiple bathing balls to expand the bathing area of the bathing tool.

Preferably, the bathing ball further comprises a suction cup. The suction cup comprises a suction cup body and a stem. The stem has one end thereof connected to the suction cup body, and an opposing end thereof connected to a back side of the second mounting portion of the second back panel of the base. The handle further comprises an engagement notch spaced above the third mating connection portion for engagement with the stem of the suction cup to prohibit rotation of the bathing ball relative to the handle.

Preferably, the first mating connection portions of the first back panel of the base of the bathing ball are stepped rods. The handle further comprises a raised portion disposed above the third mating connection portion engageable in between two adjacent second rib portions of the second back panel of the base, and a fourth mating connection portion located at the raised portion and detachably fastened to one first mating connection portion of the first back panel of the base of the bathing ball to prohibit rotation of the bathing ball relative to the handle.

Preferably, the first mating connection portions of the first back panel of the base of the bathing ball are stepped rods. The handle further comprises a fourth mating connection portion disposed in parallel to said third mating connection portion and detachably fastened to one first mating connection portion of the first back panel of the base of the bathing ball to prohibit rotation of the bathing ball relative to the handle.

Preferably, the first mating connection portions of the first back panel of the base of the bathing ball are stepped rods. The handle further comprises two fourth mating connection portions transversely spaced from each other. The fourth mating connection portions are stepped through holes. The third mating connection portion is disposed between the two fourth mating connection portions. Through the two fourth mating connection portions, the handle is detachably fastened to corresponding first mating connection portion of the first back panel of the base of the bathing ball to prohibit rotation of the bathing ball relative to the handle.

Preferably, the second mating connection portions of the second back panel of the base of the bathing ball are stepped through holes. The handle further comprises an insertion groove located at a top side thereof, and a positioning hole disposed in communication with the insertion groove. The insertion groove and the positioning hole are configured to create the third mating connection portion. One second rib portion of the second back panel of the base of the bathing ball is engaged into the insertion groove of the handle and affixed thereto with a locating pin to prohibit rotation of the bathing ball relative to the handle.

Preferably, the second mating connection portions of the second back panel of the base of the bathing ball are stepped through holes. The handle further comprises an opening located at a top side thereof, and a positioning hole disposed in communication with the opening. The opening and the positioning hole are configured to create the third mating connection portion. One second rib portion of the second back panel of the base of the bathing ball is accommodated in the opening of the handle and fastened thereto with a locating pin. The locating pin is mounted in the positioning hole of the handle and one corresponding second mating connection portion to prohibit rotation of the bathing ball relative to the handle.

Other advantages and features of the present invention will be fully understood by reference to the following specification in junction with the accompanying drawings, in which like reference signs denote like components of structure.

DETAILED DESCRIPTION OF THE INVENTION

The technical content and features of the present invention will now be explained hereinafter with reference to the annexed drawings. The directional terms "front side", "back side", "top side" and "outer side" mentioned in the content of this specification are merely descriptive terms based on the normal use direction, and are not intended to limit the scope of claims.

Figure 1:
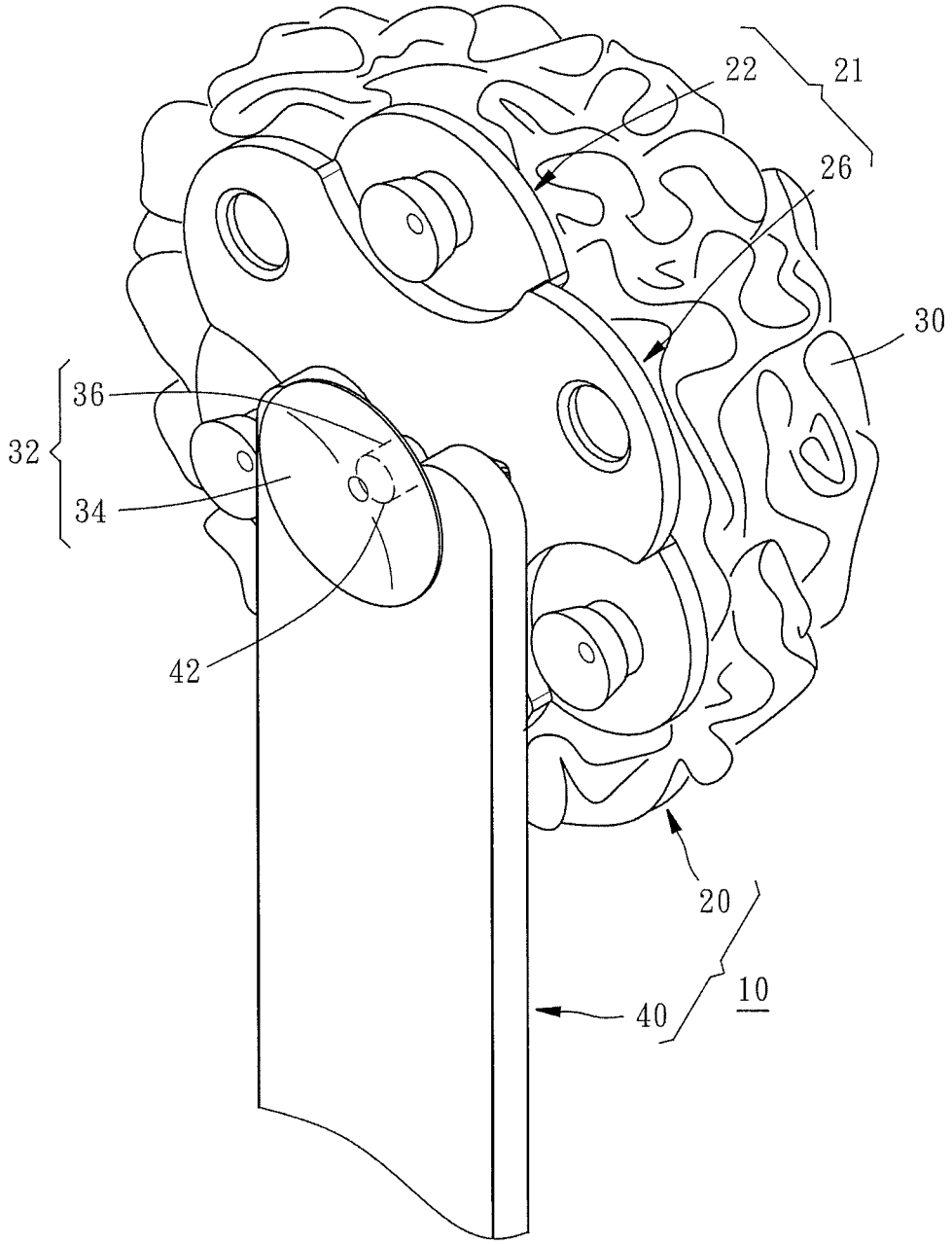
FIG. 1 is an oblique rear elevational view of a bathing tool in accordance with a first embodiment of the present invention.
Figure 2:
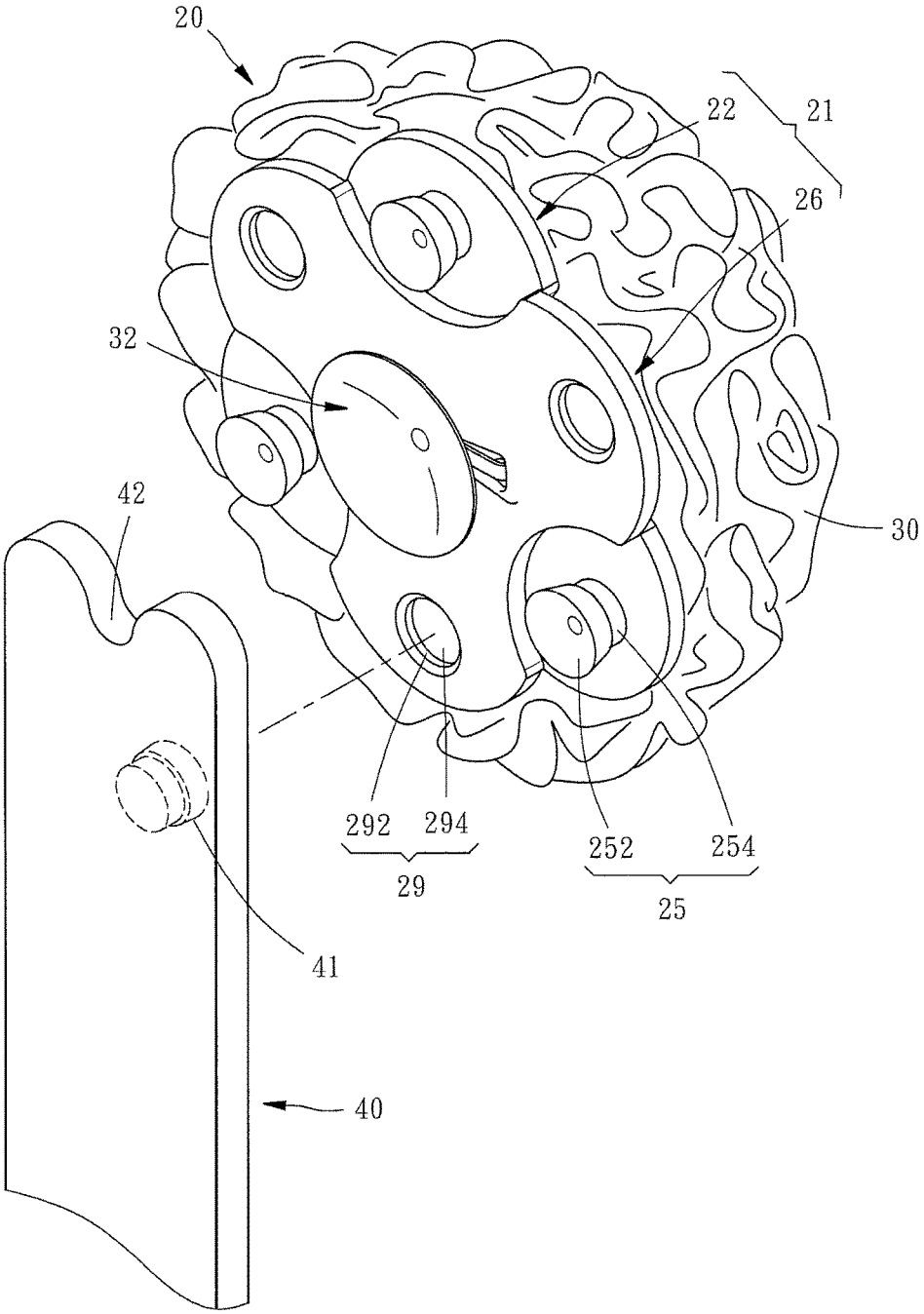
FIG. 2 is an exploded view of the bathing tool in accordance with the first embodiment of the present invention.

Referring to FIGS. 1 and 2, a bathing tool 10 in accordance with a first embodiment of the present invention is shown. The bathing tool 10 comprises a bathing ball 20 and a handle 40.

Figure 3:
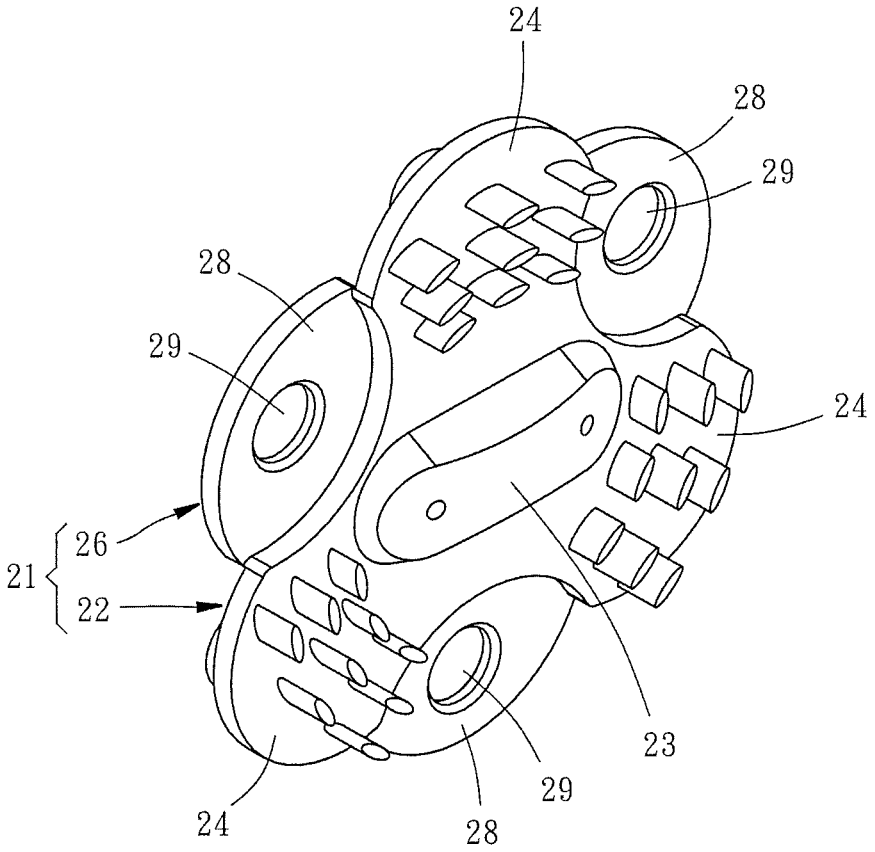
FIG. 3 is an oblique front elevational view of the base of the bathing tool in accordance with the first embodiment of the present invention.
Figure 4:
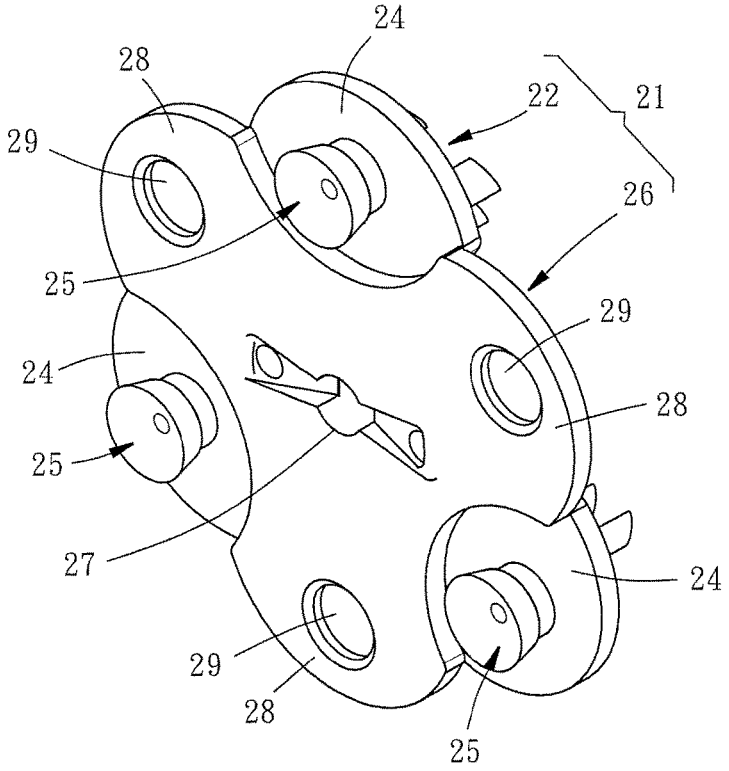
FIG. 4 is an oblique rear elevational view of the base of the bathing tool in accordance with the first embodiment of the present invention.

The bathing ball 20 comprises a base 21, as illustrated in FIGS. 3 and 4. The base 21 comprises a first back panel 22 and a second back panel 26. The first back panel 22 comprises a first mounting portion 23, three first rib portions 24 outwardly extended from an outer perimeter of the first mounting portion 23 and equiangularly spaced around the first mounting portion 23, and a first mating connection portion 25 located at a back side of each first rib portion 24. In this embodiment, the first mating connection portion 25 is a stepped rod comprising a large diameter portion 252 and a small diameter portion 254 connected to the large diameter portion 252. The second back panel 26 comprises a second mounting portion 27, three second rib portions 28 outwardly extended from an outer perimeter of the second mounting portion 27 and equiangularly spaced around the second mounting portion 27, and a second mating connection portion 29 located at a back side of each second rib portion 28. In this embodiment, the second mating connection portions 29 are through holes cut through opposing front and back sides of the base 21. Structurally, the second mating connection portions 29 (through holes) are stepped through holes configured to mate with the first mating connection portions 25 (stepped rods), each comprising a large hole portion 292 and a small hole portion 294 connected to the large hole portion 292. The large hole portions 292 and small hole portions 294 of the second mating connection portions 29 (stepped through holes) are configured corresponding to the large diameter portions 252 and small diameter portions 254 of the first mating connection portions 25 (stepped rods) respectively. When joining the first back panel 22 and the second back panel 26, the front side of the second mounting portion 27 of the second back panel 26 connected to the back side of the first mounting portion 23 of the first back panel 22 so that the first back panel 22 and the second back panel 26 are affixed together in a stack with the second rib portions 28 of the second back panel 26 and the first rib portions 24 of the first back panel 22 alternatively arranged in a staggered manner.

Referring to FIGS. 1 and 2 again, the bathing ball 20 further comprises a bathing ball body 30 and a suction cup 32. The bathing ball body 30 is made of a tubular mesh material and affixed to the front side of the first back panel 22 of the base 21. The bathing ball body 30 is adapted for scrubbing the body of a human being. The suction cup 32 comprises a suction cup body 34 and a stem 36. The stem 36 has one end thereof connected with the suction cup body 34, and an opposite end thereof connected to the back side of the second mounting portion 27 of the second back panel 26 of the base 21. The suction cup 32 is adapted for fastening the bathing ball 20 to a wall or floor of a bathroom.

Figure 5:
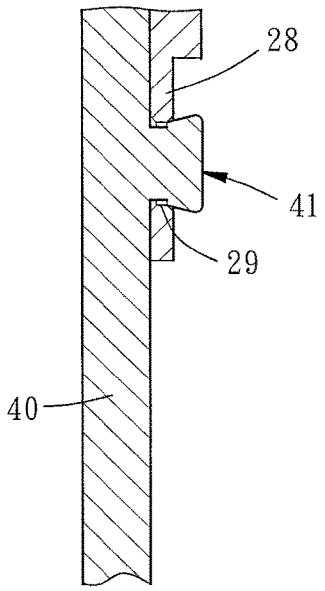
FIG. 5 is a sectional view of a part of the bathing tool in accordance with the first embodiment of the present invention, illustrating the relationship between the second mating connection portion of the base and the third mating connection portion of the handle.

Referring to FIGS. 1 and 2 again, the handle 40 comprises a third mating connection portion 41, and an engagement notch 42 disposed above the third mating connection portion 41. Structurally, the third mating connection portion 41 is a stepped rod mating with the second mating connection portions 29 (stepped through holes). When assembling the bathing ball 20 and the handle 40, as illustrated in FIGS. 1, 2 and 5, the third mating connection portion 41 of the handle 40 is selectively forced into engagement with one second mating connection portion 29 of the second back panel 26 of the base 21 of the bathing ball 20, and the engagement notch 42 of the handle 40 is forced into engagement with the stem 36 of the suction cup 32 to stop the bathing ball 20 from rotation relative to the handle 40. After assembled the bathing ball 20 and the handle 40, the user can hold the handle 40 to manipulate the bathing ball 20, forcing the bathing ball 20 to scrub the back, the sole or any other part of the body, making the scrubbed part clean and increasing the ease of use.

Figure 6:
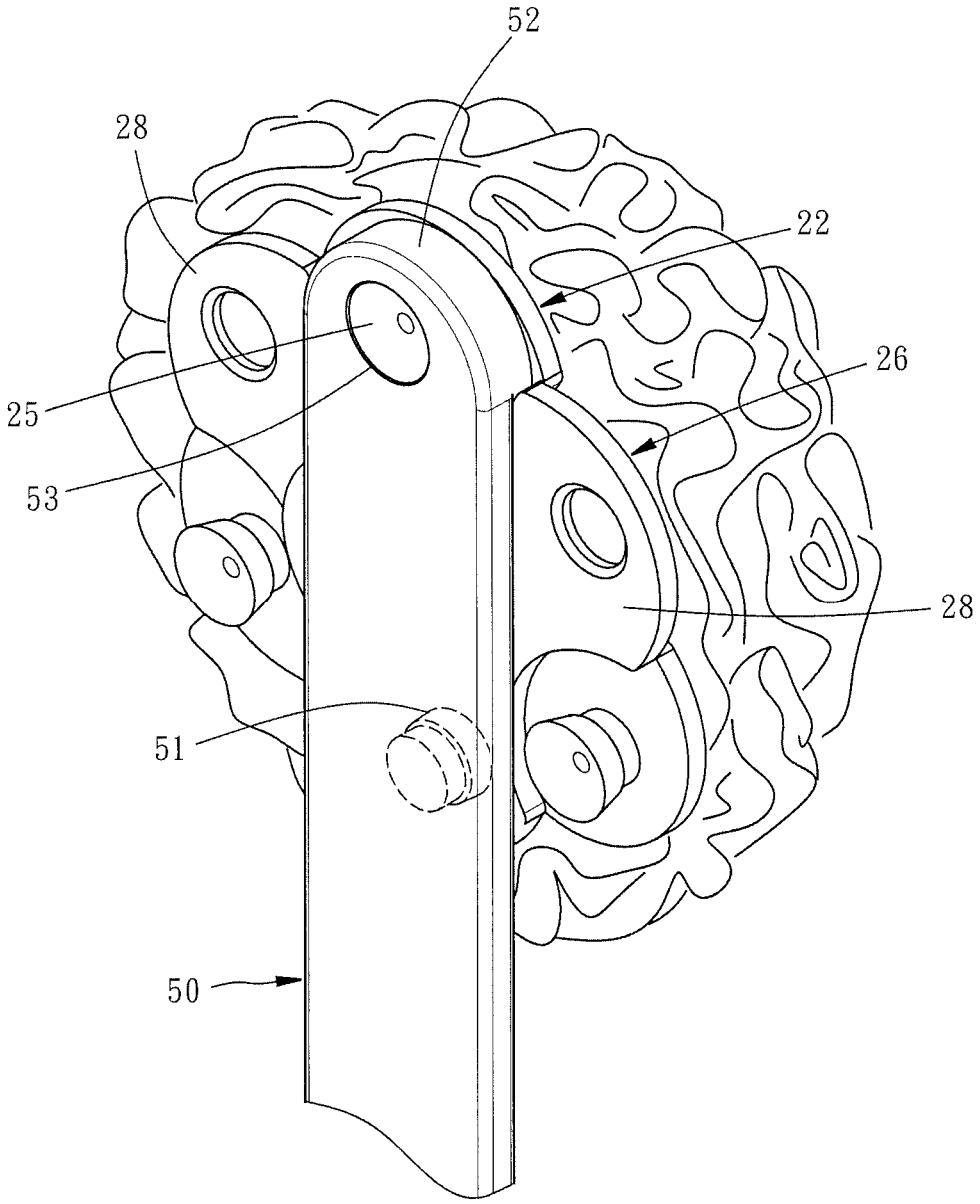
FIG. 6 is an oblique rear elevational view of a bathing tool in accordance with a second embodiment of the present invention.
Figure 7:
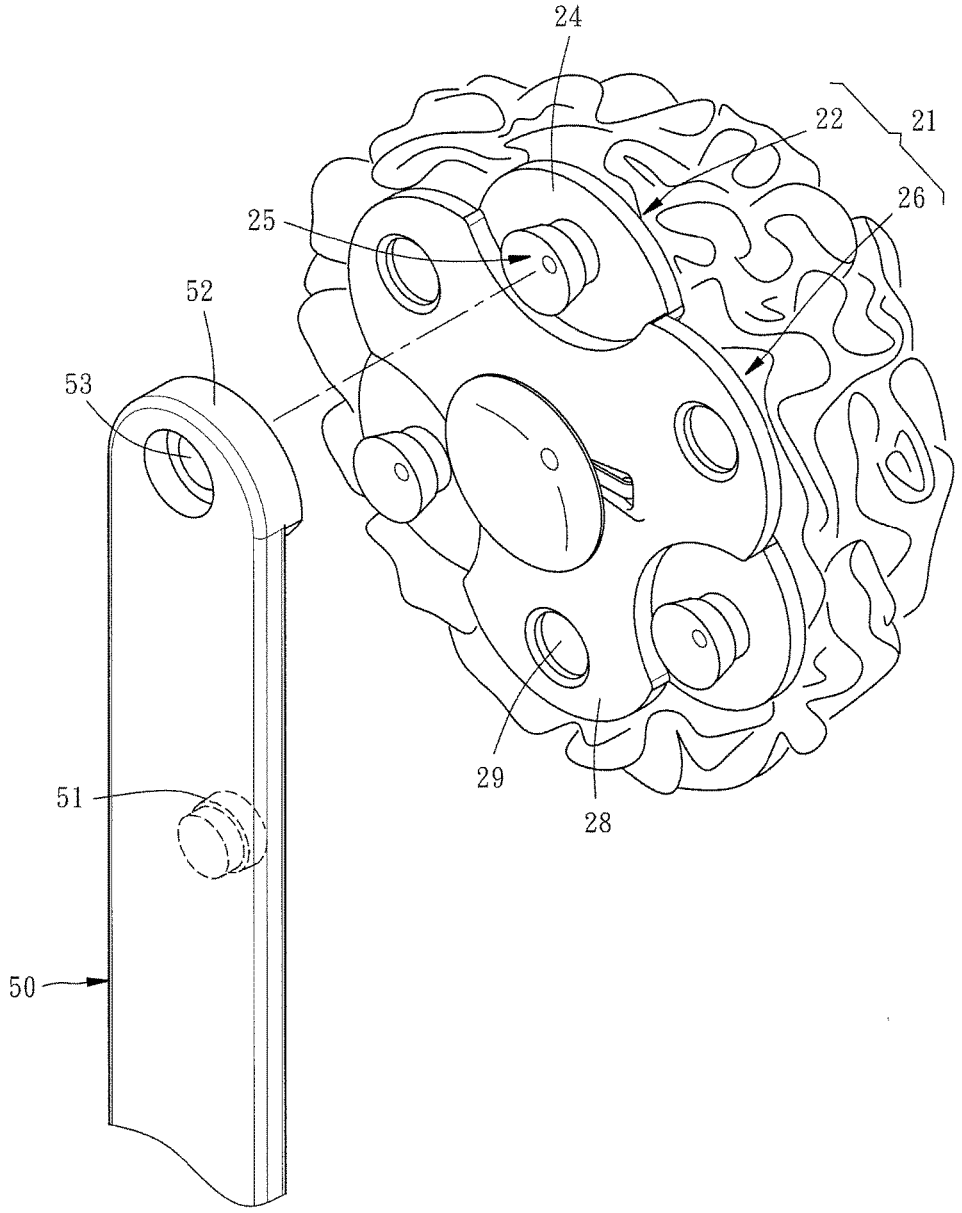
FIG. 7 is an exploded view of the bathing tool in accordance with the second embodiment of the present invention.
Figure 8:
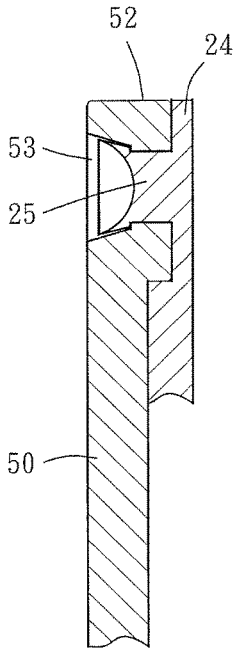
FIG. 8 is a sectional view of a part of the bathing tool in accordance with the second embodiment of the present invention, illustrating the relationship between the first mating connection portion of the base and the fourth mating connection portion of the handle.

On the other hand, the structure of the handle 40 can be variously embodied to assemble with the bathing ball 20. As illustrated in FIGS. 6-8, in a second embodiment of the present invention, the handle, referenced by 50, comprises a third mating connection portion 51 that is a stepped rod for engagement with one second mating connection portion 29 (stepped through hole) of the second back panel 26, a raised portion 52 spaced above the third mating connection portion 51, and a fourth mating connection portion 53 that is a stepped through hole located on the raised portion 52 and adapted for engagement with one first mating connection portion 25 (stepped rod) of the first back panel 22. In installation of the bathing ball 20, engage the raised portion 52 of the handle 50 in between two adjacent second rib portions 28 of the second back panel 26 of the base 21, and respectively force the fourth mating connection portion 53 into engagement with one first mating connection portion 25 at a top side and the third mating connection portion 51 into engagement with one second mating connection portion 29 at an opposing bottom side. The above described structural design prohibits relative rotation between the bathing ball 20 and the handle 50 after installation of the bathing tool.

Figure 9:
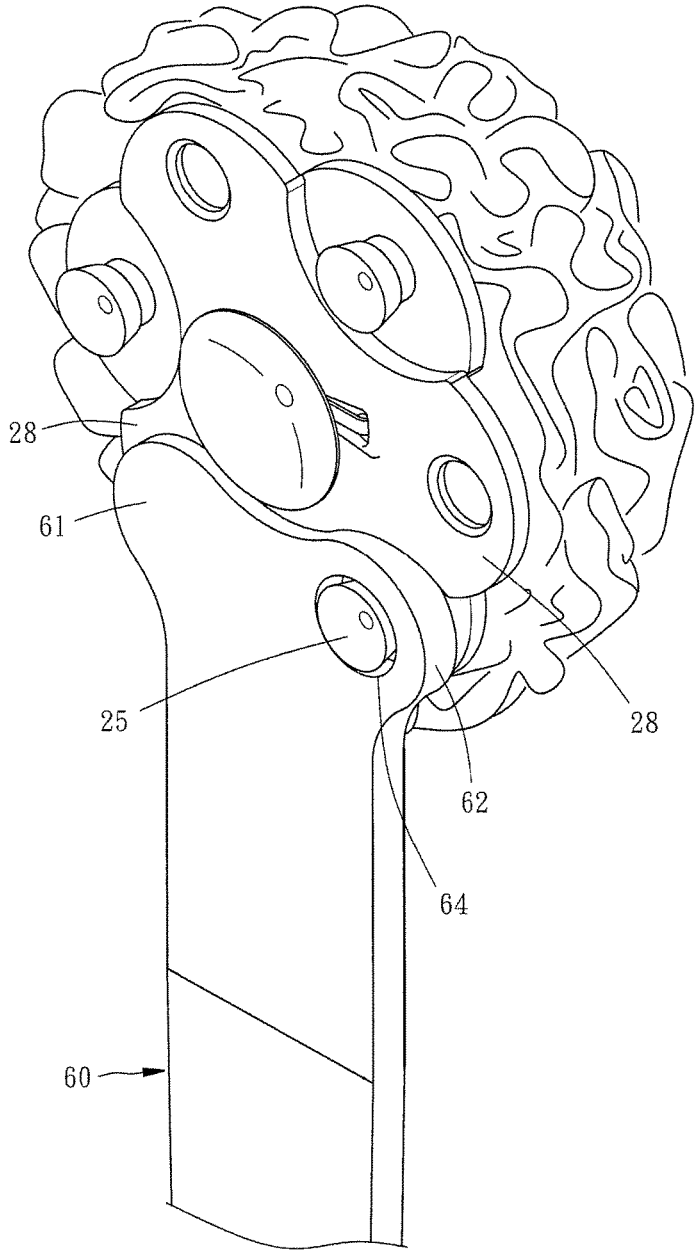
FIG. 9 is an oblique rear elevational view of a bathing tool in accordance with a third embodiment of the present invention.
Figure 10:
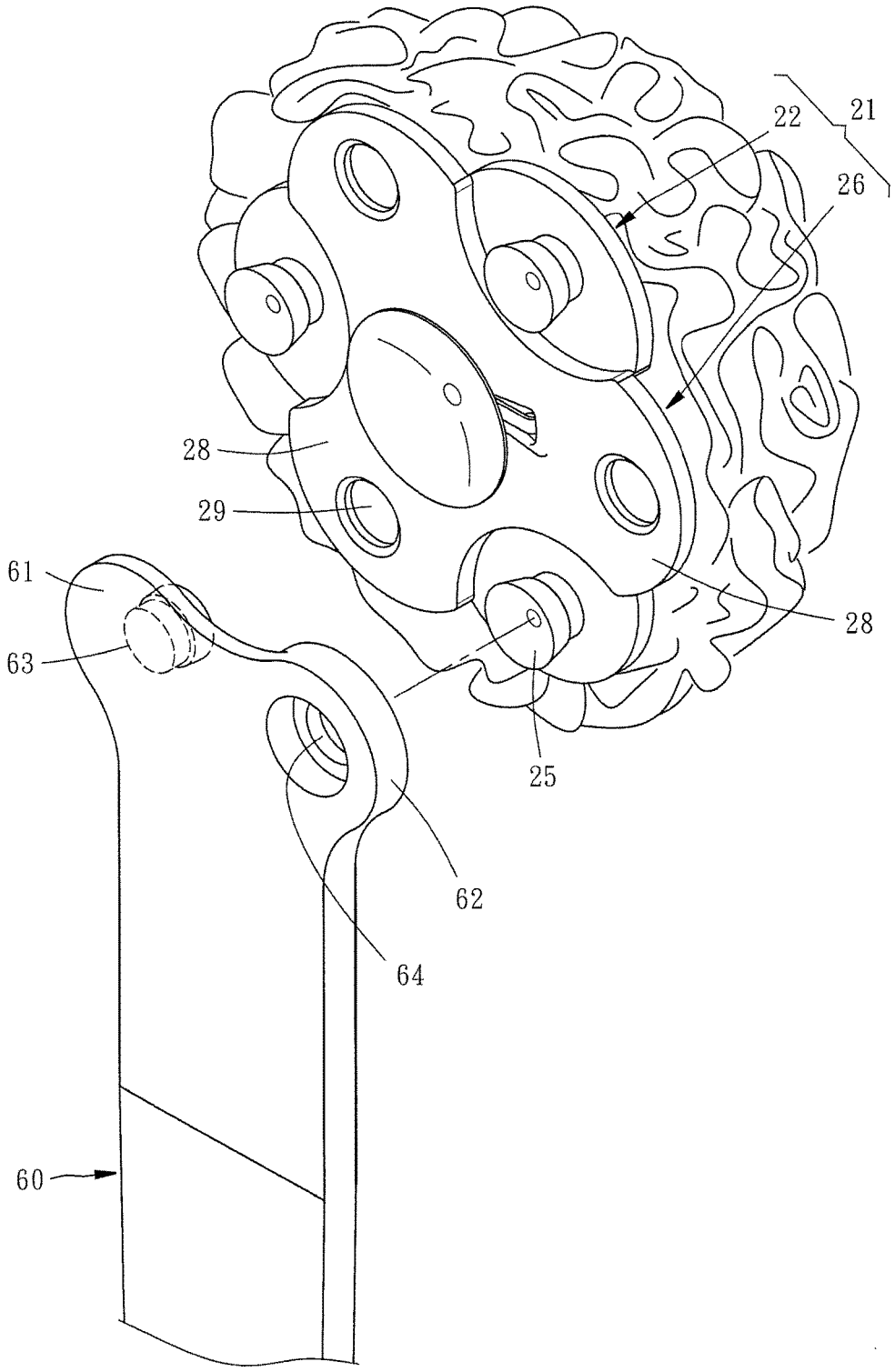
FIG. 10 is an exploded view of the bathing tool in accordance with the third embodiment of the present invention.

Referring to FIGS. 9 and 10, in a third embodiment, the handle 60 comprises a relatively thinner first lug 61 and a relatively thicker second lug 62 arranged in parallel at a top side thereof, a third mating connection portion 63 (stepped rod) located at the first lug 61, and a fourth mating connection portion 62 (stepped through hole) located at the second lug 62. In installation of the bathing ball 20, engage the second lug 62 in between two adjacent second rib portions 28 of the second back panel 26 of the base 21, and also force the fourth and third mating connection portions 64,63 into engagement with one first mating connection portion 25 and one adjacent second mating connection portion 29 of the base 21. The above described structural design prohibits relative rotation between the bathing ball 20 and the handle 60 after installation of the bathing tool.

Figure 11:
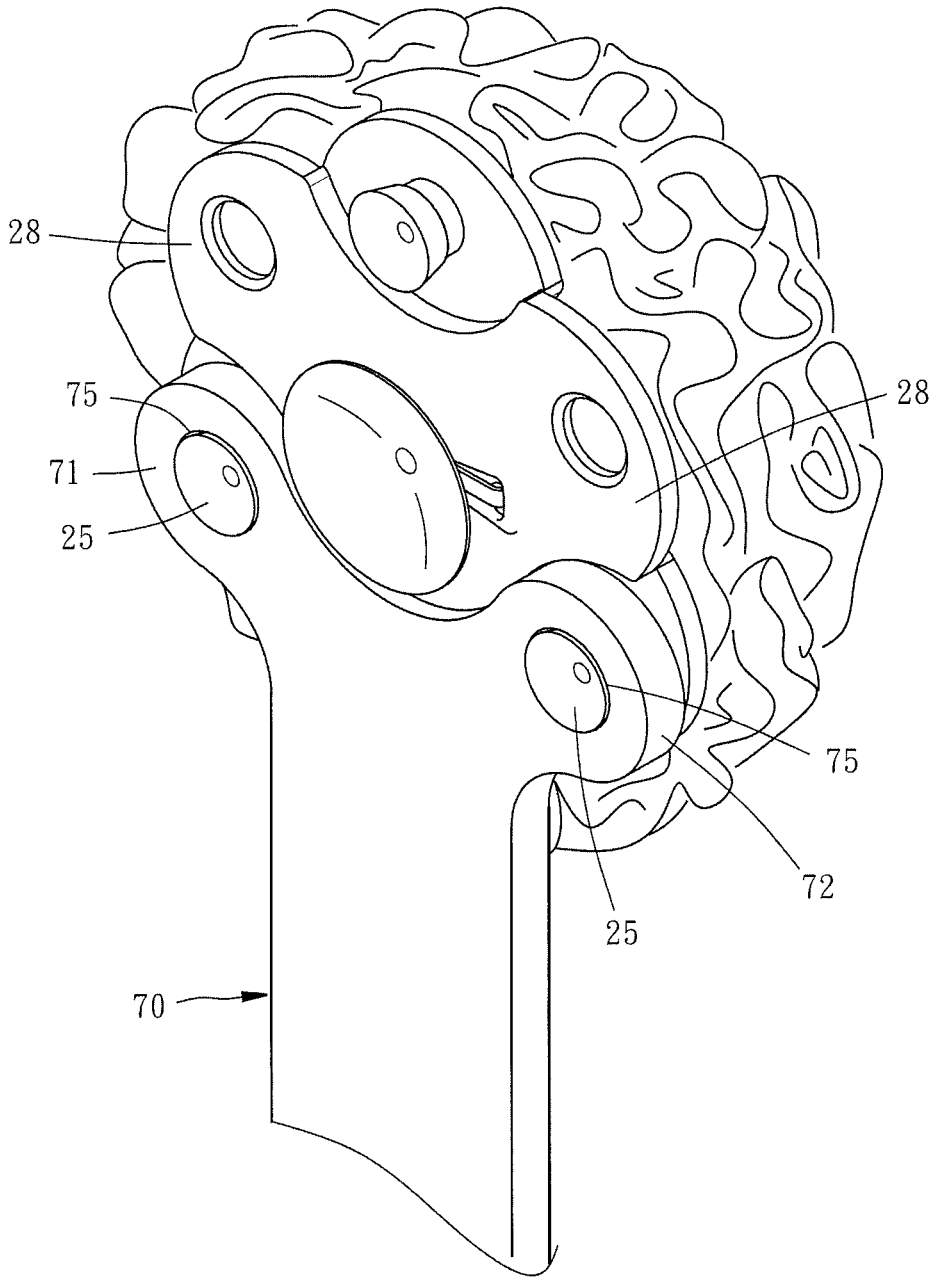
FIG. 11 is an oblique rear elevational view of a bathing tool in accordance with a fourth embodiment of the present invention.
Figure 12:
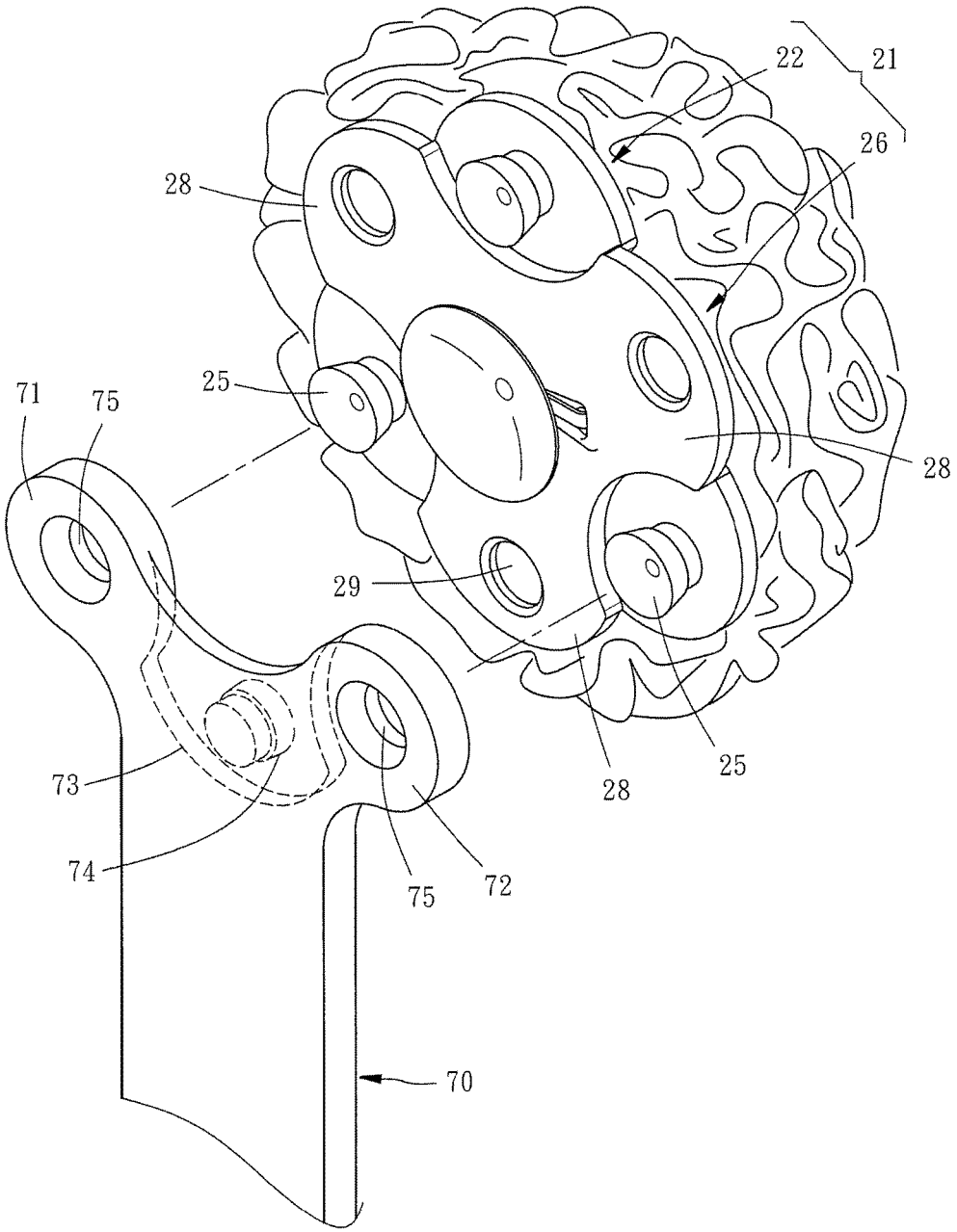
FIG. 12 is an exploded view of the bathing tool in accordance with the fourth embodiment of the present invention.

Referring to FIGS. 11 and 12, in a fourth embodiment, the handle 70 comprises a first lug 71 and a second lug 72 arranged in parallel at a top side thereof, a connection portion 73 that has a thickness relatively thinner than the first lug 71 and the second lug 72 and is connected between the first lug 71 and the second lug 72, a third mating connection portion 74 (stepped rod) located at the connection portion 73, and a fourth mating connection portion 75 (stepped through hole) located at each of the first and second lugs 61, 62. In installation of the bathing ball 20, respectively engage the first and second lugs 71,72 of the handle 70 in between two second rib portions 28 of the second back panel 26 of the base 21, and force the two fourth mating connection portions 75 and the third mating connection portion 74 into engagement with left and right-sided first mating connection portions 25 of the base 21 and one second mating connection portion 29 between these left and right-sided first mating connection portions 25. The above described structural design prohibits relative rotation between the bathing ball 20 and the handle 70 after installation of the bathing tool.

Figure 13:
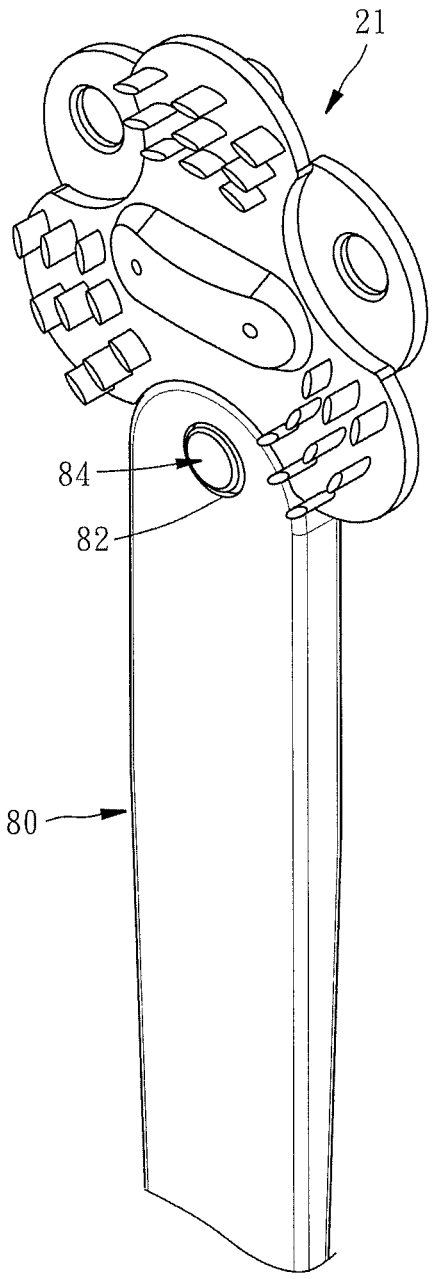
FIG. 13 is a rear elevational view of a bathing tool in accordance with a fifth embodiment of the present invention (the bathing ball body excluded).
Figure 14:
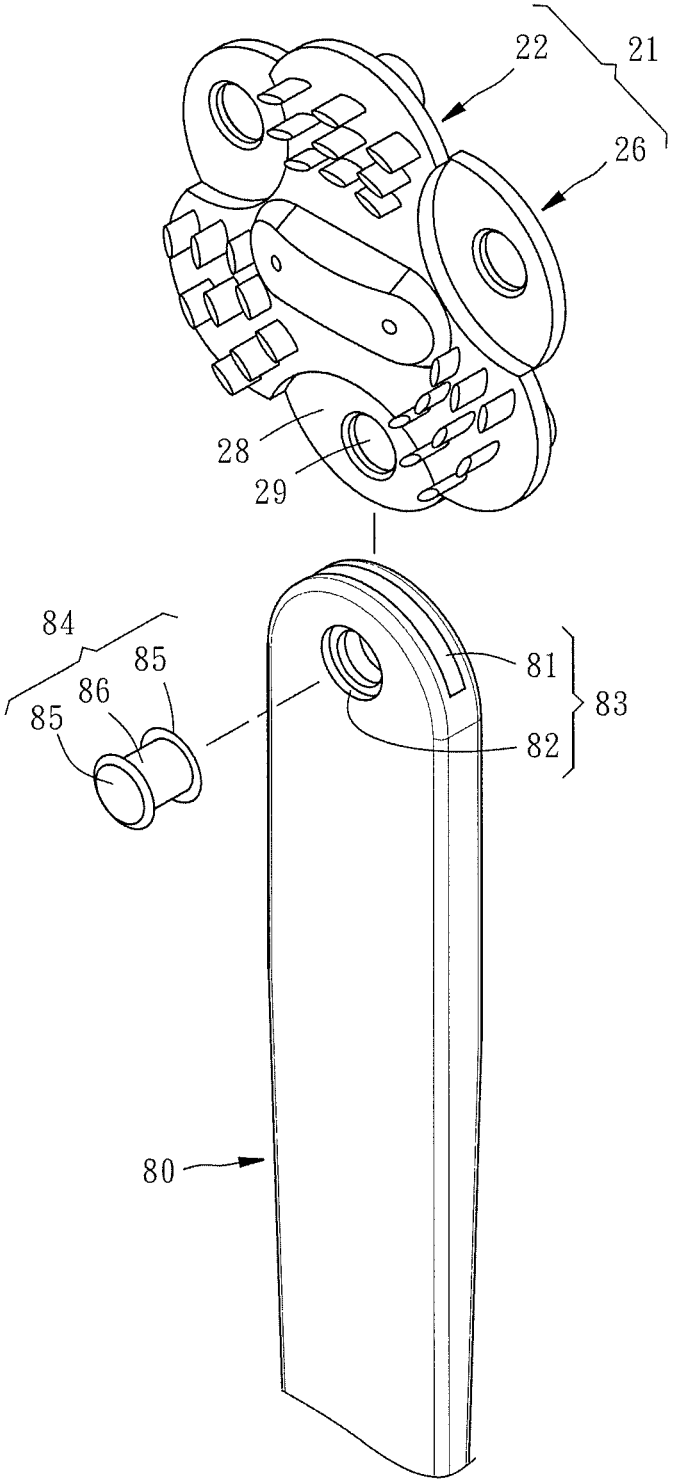
FIG. 14 is an exploded view of FIG. 13.
Figure 15:
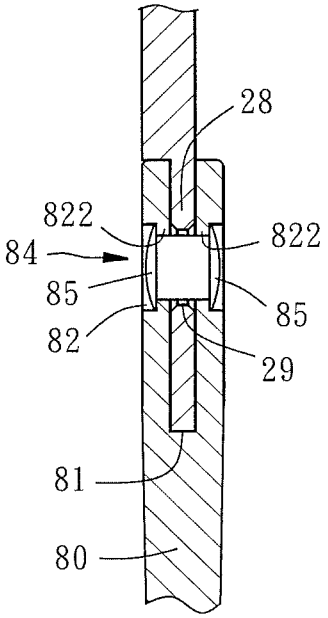
FIG. 15 is a sectional assembly view of a part of the bathing tool in accordance with the fifth embodiment of the present invention.

Referring to FIGS. 13 and 14, in a fifth embodiment, the handle 80 comprises an insertion groove 81 defined in a top side thereof, a positioning hole 82 disposed in communication with the insertion groove 81. The insertion groove 81 and the positioning hole 82 are configured to create a third mating connection portion 83. Further, two bearing flanges 822 are respectively located in the positioning hole 82 at two opposite lateral sides of the insertion groove 81. When assembling the handle 80 and the base 21 of the bathing ball 20, insert one second rib portion 28 of the second back panel 26 of the base 21 into the insertion groove 81 of the handle 80, and then fasten the handle 80 and the base 21 of the bathing ball 20 together with a locating pin 84. As illustrated in FIG. 15, the locating pin 84 comprises a cylindrical shaft 86 press-fitted into the positioning hole 82 of the handle 80 and the corresponding second mating connection portion 29 (stepped through hole), and two heads 95 respectively located at two opposite ends of the cylindrical shaft 86 and respectively abutted against the two bearing flanges 822 in the positioning hole 82. The above described structural design prohibits relative rotation between the bathing ball 20 and the handle 80 after installation of the bathing tool.

Figure 17:
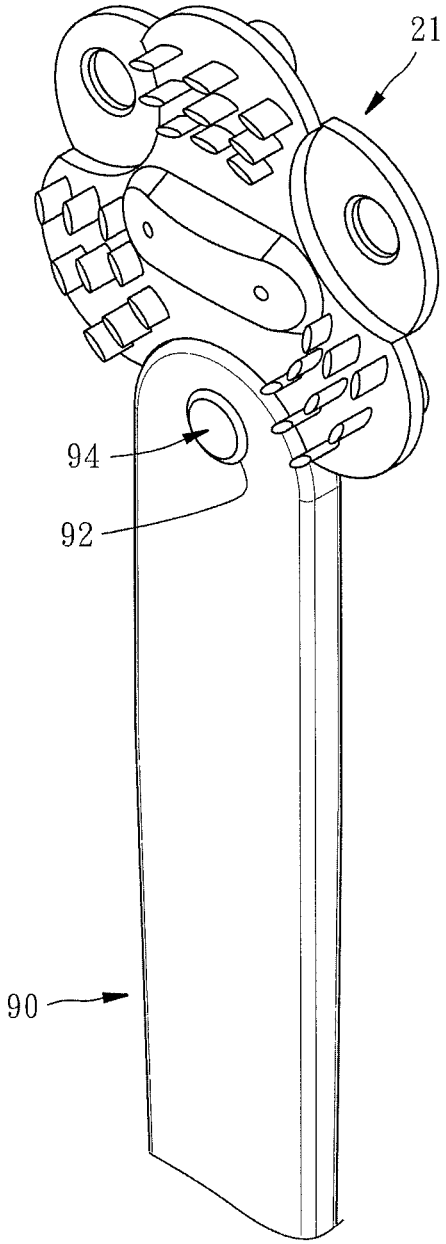
FIG. 17 is a rear elevational view of a bathing tool in accordance with a sixth embodiment of the present invention (the bathing ball body excluded).
Figure 18:
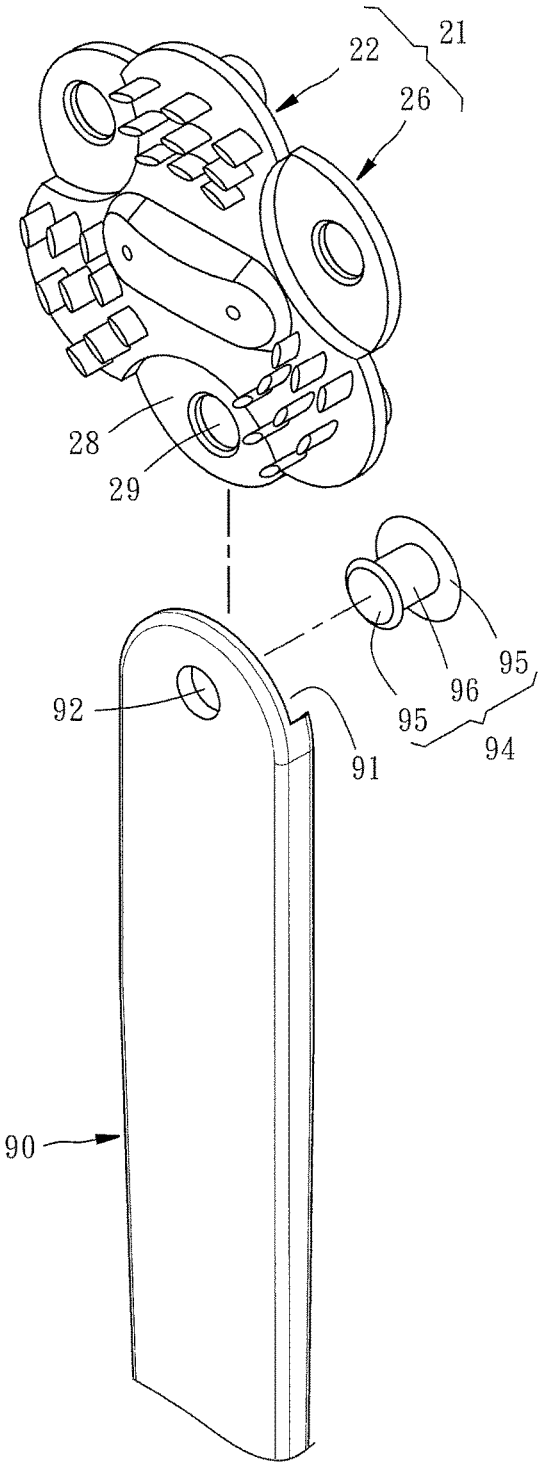
FIG. 18 is an exploded view of FIG. 17.
Figure 19:
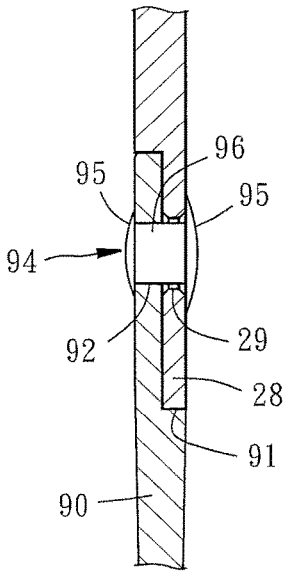
FIG. 19 is a sectional assembly view of a part of the bathing tool in accordance with the sixth embodiment of the present invention.

Referring to FIGS. 17 and 18, in a sixth embodiment, the handle 90 is substantially similar to the aforesaid fifth embodiment, using a locating pin 94 for fixation. The handle 90 of this sixth embodiment comprises an opening 91, and a positioning hole 92 disposed in communication with the opening 91. The opening 91 and the positioning hole 92 are configured to create a third mating connection portion 93. When assembling the handle 90 and the base 21 of the bathing ball 20, accommodate one second rib portion 28 of the second back panel 26 of the bathing ball 20 in the opening 91 of the handle 90, and then using a locating pin 94 to fasten the handle 90 and the base 21 of the bathing ball 20 together. As illustrated in FIG. 19, the locating pin 94 comprises a cylindrical shaft 96 press-fitted into the positioning hole 92 of the handle 90 and the corresponding second mating connection portion 29 (stepped through hole), and two heads 95 respectively located at two opposite ends of the cylindrical shaft 86 and respectively abutted against the front side of the handle 90 and the back side of the second back panel 26. The above described structural design prohibits relative rotation between the bathing ball 20 and the handle 90 after installation of the bathing tool.

Figure 16:
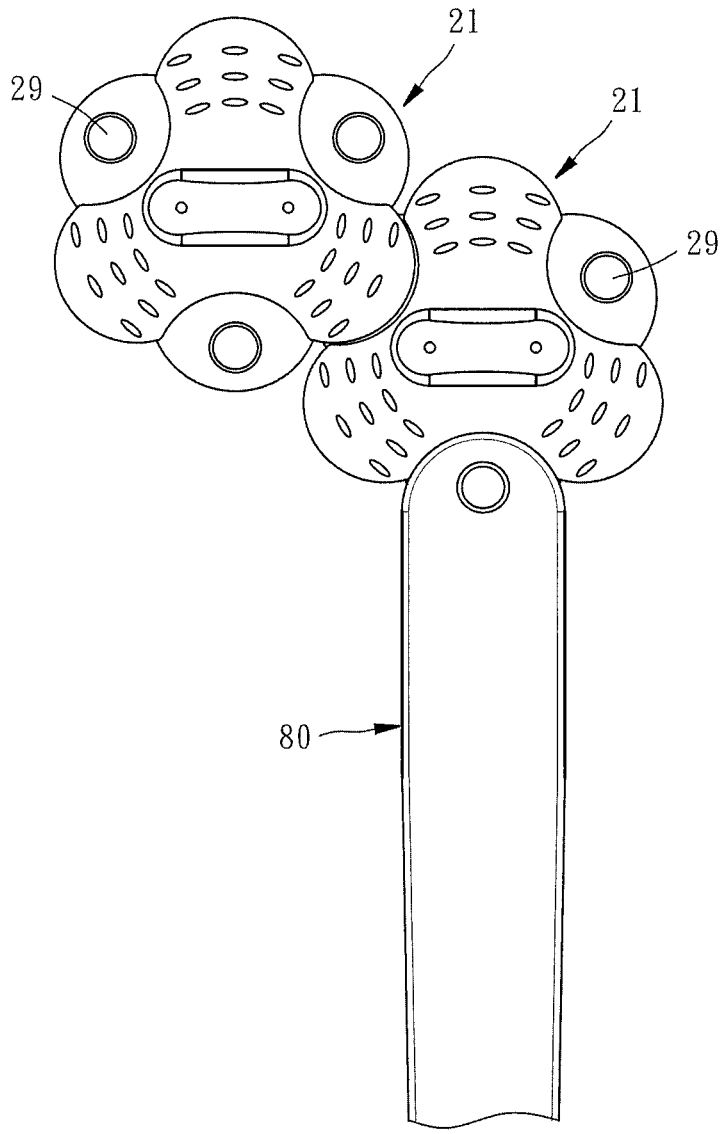
FIG. 16 is a schematic applied view of the fifth embodiment of the present invention, illustrating two bathing balls joined together.

In general, the bathing tool 10 provides various different structures of handles 20~90 for selective use with the bathing ball 20. After installation, the user can operate the handle 20~90 to scrub the bathing ball 20 over every part of the body for thorough cleaning, increasing the ease of use. Further, as illustrated in FIG. 16, the mating design between the first mating connection portions 25 and the second mating connection portions 29 allows connection of multiple bathing balls 20 in a parallel to expand the bathing area of the bathing tool 10.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bathing tool, comprising:

a bathing ball comprising a base and a bathing ball body, said base comprising a first back panel and a second back panel, said first back panel comprising a first mounting portion and a plurality of first rib portions outwardly extended from the periphery of said first mounting portion and equiangularly spaced around said first mounting portion, each said first rib portion comprising a first mating connection portion, said second back panel comprising a second mounting portion and a plurality of second rib portions outwardly extended from the periphery of said second mounting portion and equiangularly spaced around said second mounting portion, said second mounting portion having a front side thereof connected to a back side of said first mounting portion of said first back panel, said second rib portions of said second back panel and said first rib portions of said first back panel being alternatively arranged in a staggered manner, each said second rib portion comprising a second mating connection portion configured to mate with said first mating connection portion, said bathing ball body being located at a front side of said first back panel of said base; and a handle comprising a third mating connection portion detachably connectable to one said second mating connection portion of said second back panel of said base of said bathing ball.

2. The bathing tool as claimed in claim 1, wherein said first mating connection portions of said first back panel and said third mating connection portion of said handle are stepped rods; said second mating connection portions of said second back panel are stepped through holes.

3. The bathing tool as claimed in claim 2, wherein said bathing ball further comprises a suction cup, said suction cup comprising a suction cup body and a stem, said stem having one end thereof connected to said suction cup body and an opposing end thereof connected to a back side of said second mounting portion of said second back panel of said base; said handle further comprises an engagement notch spaced above said third mating connection portion for engagement with said stem of said suction cup.

4. The bathing tool as claimed in claim 2, wherein each said stepped through hole comprises a large hole portion and a small hole portion connected to said large hole portion; each said stepped rod comprises a large diameter portion fitting said large hole portion and a small diameter portion connected to said large diameter portion and fitting said small hole portion.

5. The bathing tool as claimed in claim 1, wherein said handle further comprises a raised portion disposed above said third mating connection portion and engageable in between two adjacent said second rib portions of said second back panel of said base, and a fourth mating connection portion located at said raised portion and detachably fastened to one said first mating connection portion of said first back panel of said base of said bathing ball.

6. The bathing tool as claimed in claim 5, wherein said first mating connection portions of said first back panel and said third mating connection portion of said handle are stepped rods; said second mating connection portions of said second back panel and said fourth mating connection portion of said handle are stepped through holes.

7. The bathing tool as claimed in claim 6, wherein each said stepped through hole comprises a large hole portion and a small hole portion connected to said large hole portion; each said stepped rods comprises a large diameter portion fitting said large hole portion and a small diameter portion connected to said large diameter portion and fitting said small hole portion.

8. The bathing tool as claimed in claim 1, wherein said handle further comprises a fourth mating connection portion disposed in parallel to said third mating connection portion and detachably fastenable to one said first mating connection portion of said first back panel of said base of said bathing ball.

9. The bathing tool as claimed in claim 8, wherein said handle comprises a first lug and a second lug located at a top side thereof in a parallel manner, said first lug being relatively thinner than said second lug, said first lug carrying said third mating connection portion, said second lug carrying said fourth mating connection portion, said second lug being engageable in between two adjacent said second rib portions of said second back panel of said base.

10. The bathing tool as claimed in claim 9, wherein said first mating connection portions of said first back panel and said third mating connection portion of said handle are stepped rods; said second mating connection portions of said second back panel and said fourth mating connection portion of said handle are stepped through holes.

11. The bathing tool as claimed in claim 10, wherein each said stepped through hole comprises a large hole portion and a small hole portion connected to said large hole portion; each said stepped rod comprises a large diameter portion fitting said large hole portion and a small diameter portion connected to said large diameter portion and fitting said small hole portion.

12. The bathing tool as claimed in claim 1, wherein said handle further comprises two fourth mating connection portions transversely spaced from each other and respectively detachably connected to two corresponding said first mating connection portion of said first back panel of said base of said bathing ball; said third mating connection portion is disposed between said two fourth mating connection portion.

13. The bathing tool as claimed in claim 12, wherein said handle further comprise a first lug and a second lug located at a top side thereof in a parallel manner and respectively engageable in between respective two adjacent said second rib portions of said second back panel of said base and a connection portion connected between said first lug and said second lug, said first lug and said second lug being thicker than said connection portion, said connection portion carrying said third mating connection portion, said first lug and said second lug respectively carrying said two fourth mating connection portions.

14. The bathing tool as claimed in claim 13, wherein said first mating connection portions of said first back panel and said third mating connection portion of said handle are stepped rods; said second mating connection portions of said second back panel and said fourth mating connection portion of said handle are stepped through holes.

15. The bathing tool as claimed in claim 14, wherein each said stepped through hole comprises a large hole portion and a small hole portion connected to said large hole portion; each said stepped rod comprises a large diameter portion fitting said large hole portion and a small diameter portion connected to said large diameter portion and fitting said small hole portion.

16. The bathing tool as claimed in claim 1, wherein said first mating connection portions of said first back panel are stepped rods; said second mating connection portions of said second back panel are stepped through holes; said handle further comprises an insertion groove located at a top side thereof and a positioning hole disposed in communication with said insertion groove, said insertion groove and said positioning hole being configured to create said third mating connection portion; one said second rib portion of said second back panel of said base of said bathing ball is engaged into said insertion groove of said handle and affixed thereto with a locating pin, said locating pin being mounted in said positioning hole of said handle and one said second mating connection portion corresponding to said positioning hole.

17. The bathing tool as claimed in claim 16, wherein said handle further comprises two bearing flanges defined in said positioning hole at two opposite sides of said insertion groove; said locating pin comprises a cylindrical shaft press-fitted into said positioning hole of said handle and the corresponding said second mating connection portion, and two heads respectively located at two opposite ends of said cylindrical shaft and respectively abutted against said bearing flanges in said positioning hole.

18. The bathing tool as claimed in claim 16, wherein each said stepped through hole comprises a large hole portion and a small hole portion connected to said large hole portion; each said stepped rod comprises a large diameter portion fitting said large hole portion and a small diameter portion connected to said large diameter portion and fitting said small hole portion.

19. The bathing tool as claimed in claim 1, wherein said first mating connection portions of said first back panel are stepped rods; said second mating connection portions of said second back panel are stepped through holes; said handle comprises an opening located at a top side thereof and a positioning hole disposed in communication with said opening, said opening and said positioning hole being configured to create said third mating connection portion; one said second rib portion of said second back panel of said base of said bathing ball is accommodated in said opening of said handle and fastened thereto with a locating pin, said locating pin being mounted in said positioning hole of said handle and one corresponding said second mating connection portion.

20. The bathing tool as claimed in claim 19, wherein said locating pin comprises a cylindrical shaft press-fitted into said positioning hole of said handle and the corresponding said second mating connection portion, and two heads respectively located at two opposite ends of said cylindrical shaft and respectively abutted against a front side of said handle and a back side of said second back panel.

21. The bathing tool as claimed in claim 19, wherein each said stepped through hole comprises a large hole portion and a small hole portion connected to said large hole portion; each said stepped rod comprises a large diameter portion fitting said large hole portion and a small diameter portion connected to said large diameter portion and fitting said small hole portion.

* * * * *